US006010295A

United States Patent [19]

Sridhar

[11] Patent Number: 6,010,295

[45] Date of Patent: Jan. 4, 2000

[54] FLOATING STRUCTURE FOR THE TRANSFER OF CARGO

[75] Inventor: Sidney Sridhar, Richmond, Canada

[73] Assignee: Semisub Transshippers Inc., St. Michael, Barbados

[21] Appl. No.: 09/044,152

[22] Filed: Mar. 19, 1998

[51] Int. Cl.[7] ..... B63B 27/22; B63B 27/30

[52] U.S. Cl. ..... 414/138.5; 414/138.1; 414/138.4; 414/138.6

[58] Field of Search ..... 114/73, 61.1, 61.12, 114/230.22, 125; 414/138.5, 138.6, 137.9, 138.1, 138.4, 142.1, 142.2, 142.5

[56] References Cited

U.S. PATENT DOCUMENTS

| | | | |
|---|---|---|---|
| 1,931,107 | 10/1933 | Dowell et al. | 114/230.22 |
| 3,279,407 | 10/1966 | Stenger | 114/125 |
| 3,823,681 | 7/1974 | Cushing et al. | 114/260 |
| 3,938,676 | 2/1976 | Croese | 414/138.6 |
| 4,168,009 | 9/1979 | Ide | 414/142.1 |
| 4,304,190 | 12/1981 | Daniel | 114/61.1 |
| 4,465,012 | 8/1984 | Bos . | |
| 4,568,232 | 2/1986 | Ray . | |
| 4,784,560 | 11/1988 | Haahjem | 414/142.5 |
| 5,024,568 | 6/1991 | Johnston . | |
| 5,564,878 | 10/1996 | Kay . | |
| 5,613,820 | 3/1997 | Tschernatsch . | |

FOREIGN PATENT DOCUMENTS

| | | |
|---|---|---|
| 3030281 | 8/1982 | Germany . |
| 2298629 | 9/1996 | United Kingdom . |
| WO 94/07742 | 4/1994 | WIPO . |

*Primary Examiner*—Sherman Basinger
*Attorney, Agent, or Firm*—Elbie R. de Kock

[57] ABSTRACT

A transshipper for the transfer of cargo from a barge to a ship or elsewhere comprises a pair of buoyant vessels, a platform supported by the buoyant vessels in a raised position above the buoyant vessels through a plurality of vertical columns connecting the platform to the buoyant vessels. In one embodiment the buoyant vessels are provided with ballast chambers for receiving water as ballast inside the buoyant members. In another embodiment the transshipper is further provided with a lifting conveyor for raising material to be unloaded from a barge to the platform. Winches are provided for raising and lowering the lifting conveyor relative to the barge.

36 Claims, 13 Drawing Sheets

FLOATING STRUCTURE FOR THE TRANSFER OF CARGO

FIELD OF THE INVENTION

This invention relates to a floating structure or transshipper for the transfer of cargo from a barge to a ship or to an on shore location, as well as for other cargo transfer operations. The invention also relates to a method of material transfer.

BACKGROUND OF THE INVENTION

It is a problem with harbours without deep water docking facilities that large cargo ships cannot be accommodated. One solution to this problem is to load cargo onto a lighter barge which them travels out to deep water and is anchored alongside the cargo ship. Use is then made of a floating device for the transfer of cargo from the barge to the cargo ship.

Since the deep water locations are sometimes exposed to the open sea and subject to wave action, the stability of the transshipper is a concern. In addition, the efficient unloading of the barge is important for carrying out the cargo transfer operation economically.

SUMMARY OF THE INVENTION

According to the invention there is provided a transshipper comprising a pair of buoyant vessels, a platform supported by the buoyant vessels in a raised position above the buoyant vessel through a plurality of vertical columns or legs connecting the platform to the buoyant vessels, wherein the buoyant vessels are provided with ballast chambers therein for receiving water as ballast inside the buoyant members. The ballast chambers may extend into at least some of the vertical columns.

One of the buoyant members may have a larger water displacement surface than the other buoyant members.

Also according to the invention there is provided a transshipper comprising a pair of buoyant vessels, a platform supported by the buoyant vessels through a plurality of vertical columns or legs connecting the platform to the buoyant vessels, a lifting conveyor for raising material to be unloaded from a barge to the platform and means for raising and lowering the lifting conveyor relative to the barge.

The transshipper may further comprise scraping means for moving the material to be unloaded towards the lifting conveyor. The scraping means may comprise a pair of rotary scrapers comprising an endless member rotatably mounted on a pair of spaced sprockets and including a plurality of scraper blades spaced along the endless member. Means for changing the orientation of the scraper members relative to the lifting conveyor may be included.

Further according to the invention there is provided a transshipper comprising a pair of buoyant vessels, a platform supported by the buoyant vessels in a raised position above the buoyant vessels through a plurality of vertical columns connecting the platform to the buoyant vessels and connection means for attaching a barge, loaded with a supply of material, the connection means including traction means for effecting translational movement of the barge relative to the transshipper.

The connection means may comprise a pair of opposed traction lines for connection to opposite ends of the barge and traction winches for exerting pulling forces on the traction lines for effecting said translational movement.

Also according to the invention there is provided a method of unloading particulate or granular material from a barge by means of material handling apparatus, comprising the steps of removing material from a first selected location on the barge to a first depth, moving the barge relative to the material handling apparatus to remove material to said first depth from locations on the barge adjacent to said first selected location, removing material from a second selected location on the barge to a second depth, moving the barge relative to the material handling apparatus to remove material to said second depth from location on the barge adjacent to said second selected location and repeating the removal of material to successive depths until the barge is fully unloaded or the unloading operation is terminated.

Further objects and advantages of the invention will become apparent from the description of a preferred embodiment of the invention below.

BRIEF DESCRIPTION OF THE DRAWINGS

The invention will now be described, by way of example, with reference to the accompanying drawing, in which.

DETAILED DESCRIPTION OF PREFERRED EMBODIMENT

Figure 1:
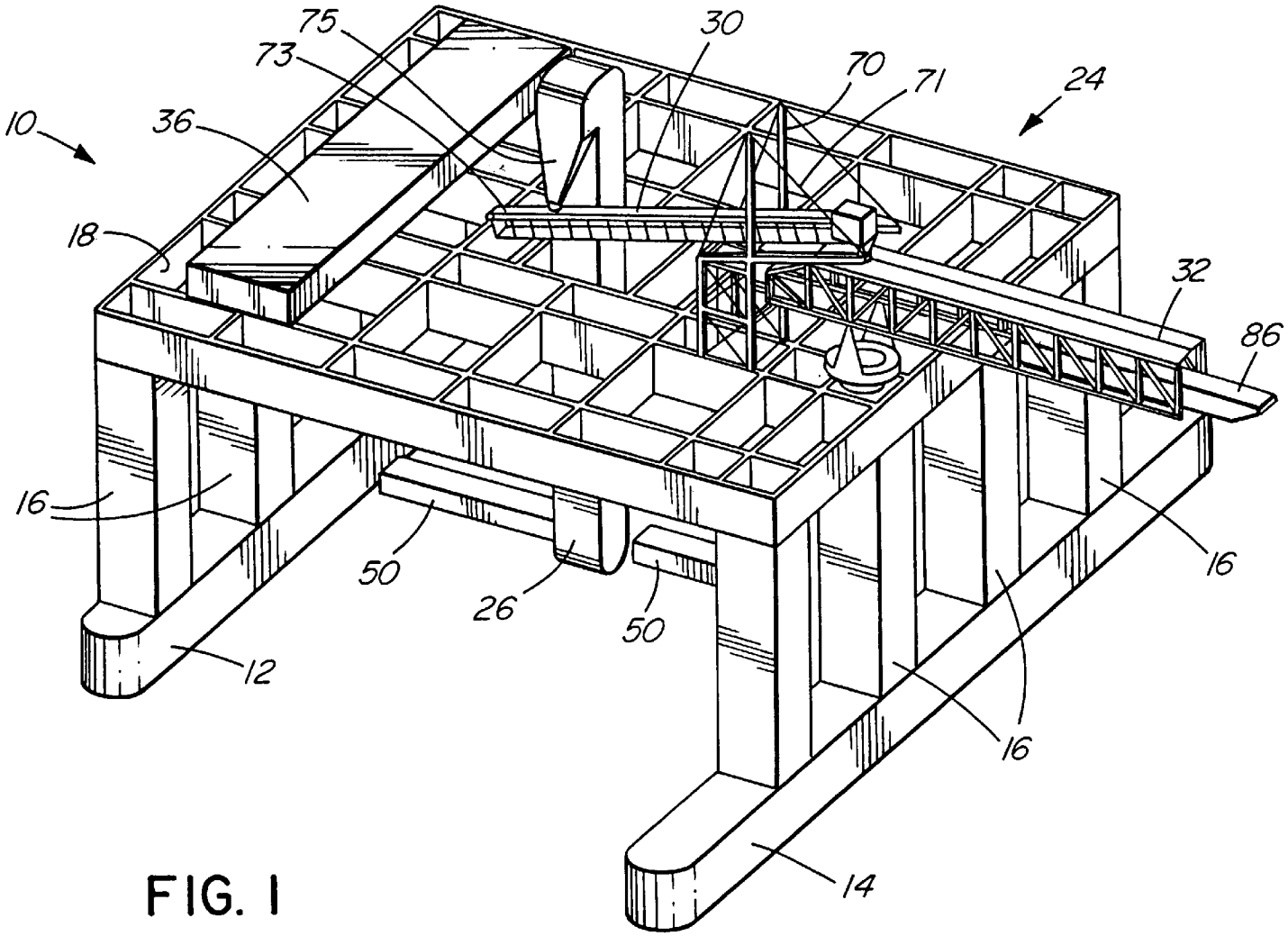
FIG. 1 is a schematical three-dimensional representation of a transshipper according to the invention.
Figure 2:
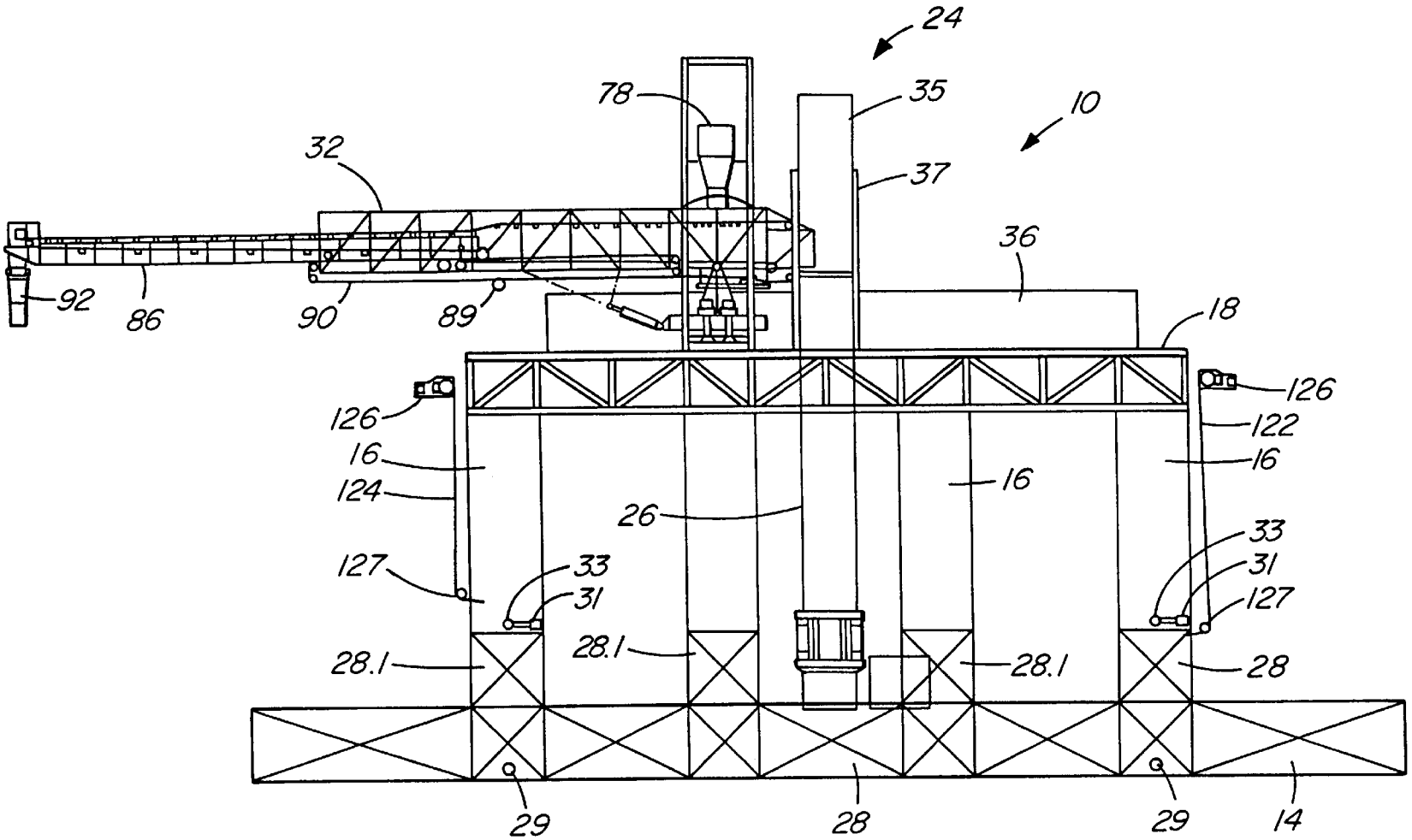
FIG. 2 is a side view of the transshipper of FIG. 1.
Figure 3:
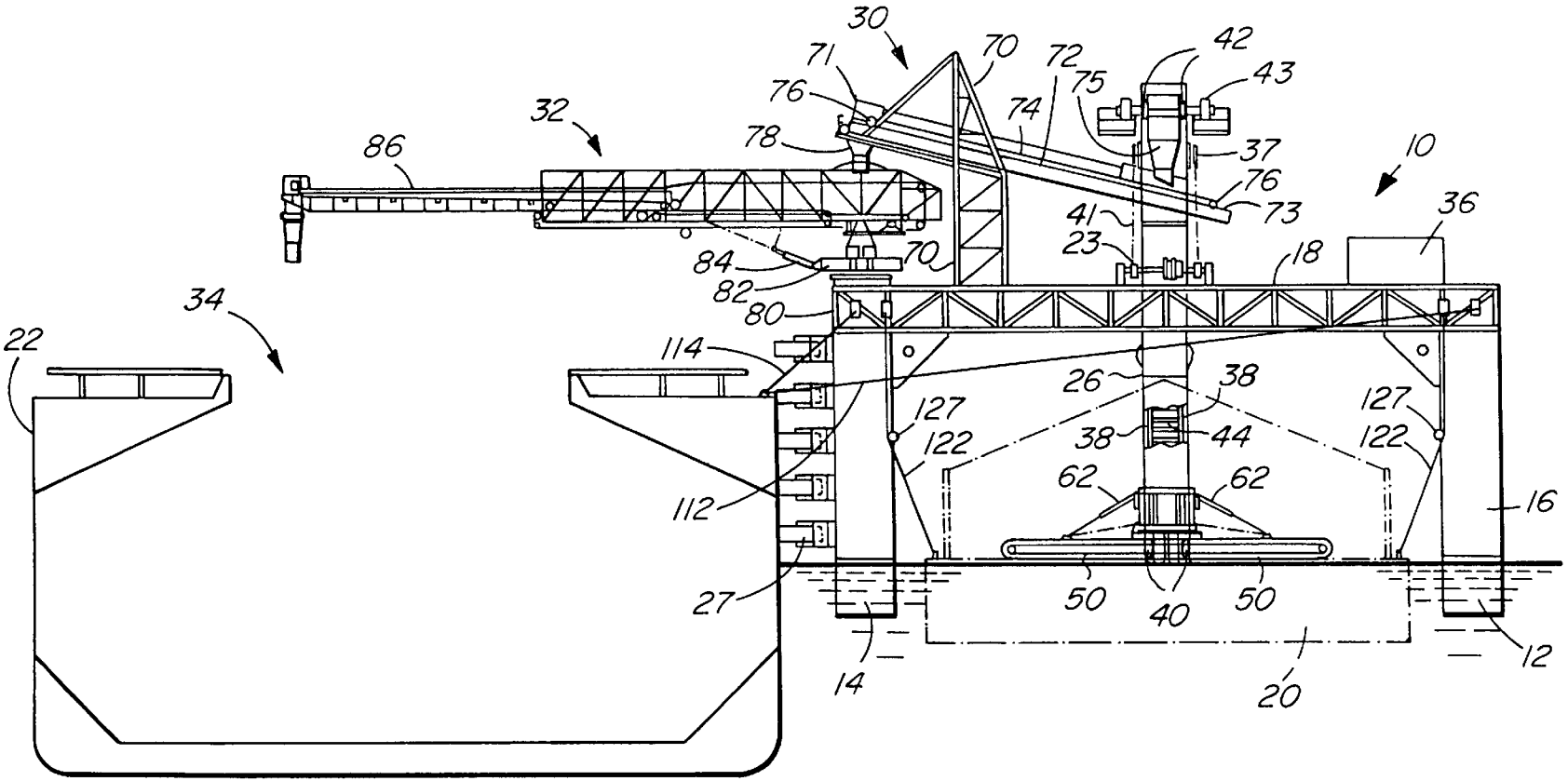
FIG. 3 is an end view showing the transshipper of FIG. 1 moored alongside a cargo ship for unloading cargo into the hull of the ship.

With reference to FIGS. 1 to 3, reference numeral 10 generally indicates a transshipper comprising a pair of buoyant vessels or pontoons 12 and 14 connected together in spaced parallel relationship through a plurality of vertical columns or legs 16 extending upwardly from each pontoon 12, 14 and a platform 18 attached to the tops of the legs 16. The platform 18 spans the space between the pontoons 12, 14.

In this specification, the term "pontoon" includes any buoyant member which will serve the purpose of supporting the platform 18 above water.

The transshipper 10 further comprises material handling apparatus 24 for transferring material or cargo from a barge 20 to a cargo ship 22. The apparatus 24 comprises a marine leg 26 for raising material from the barge 20, a transfer conveyor 30 at the upper end of the marine leg 26 and an off-loading boom 32 receiving material from the conveyor 30 for discharge into a hull 34 of the cargo ship 22.

The legs 16 are hollow shells, allowing for the passage of crew and the entry of ballast water, as will be described below. The legs 16 may also be used for storage, such as for fuel. The number of the legs 16 and their length will vary depending in the size of the platform 18 and the loads which it must support. The shape of the legs 16 may vary between round and rectangular cross-sections.

An accommodation module 36 is located on the platform 18 for housing the crew, as well as apparatus, such as electrical generator sets and hydraulic power units. The module 36 also has an electrical control room, as well as storage rooms, for spares, and a workshop, indicated generally as 39 in FIG. 16.

Figure 16:
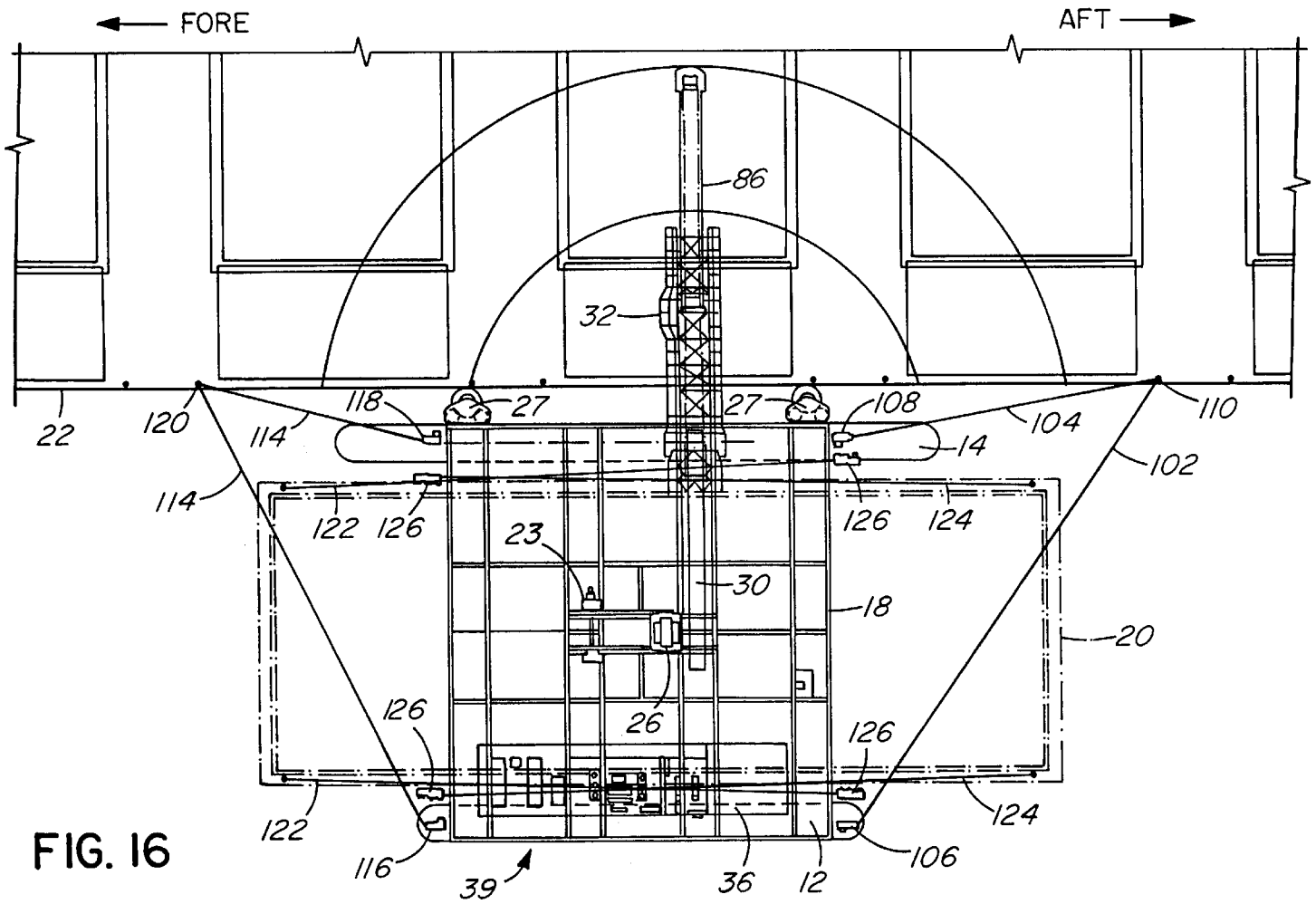
FIG. 16 is a plan view of the transshipper of FIG. 1 showing winch mechanisms for anchoring the transshipper to a cargo ship and for effecting relevant movement between the transshipper and a barge being unloaded.
Figure 17:
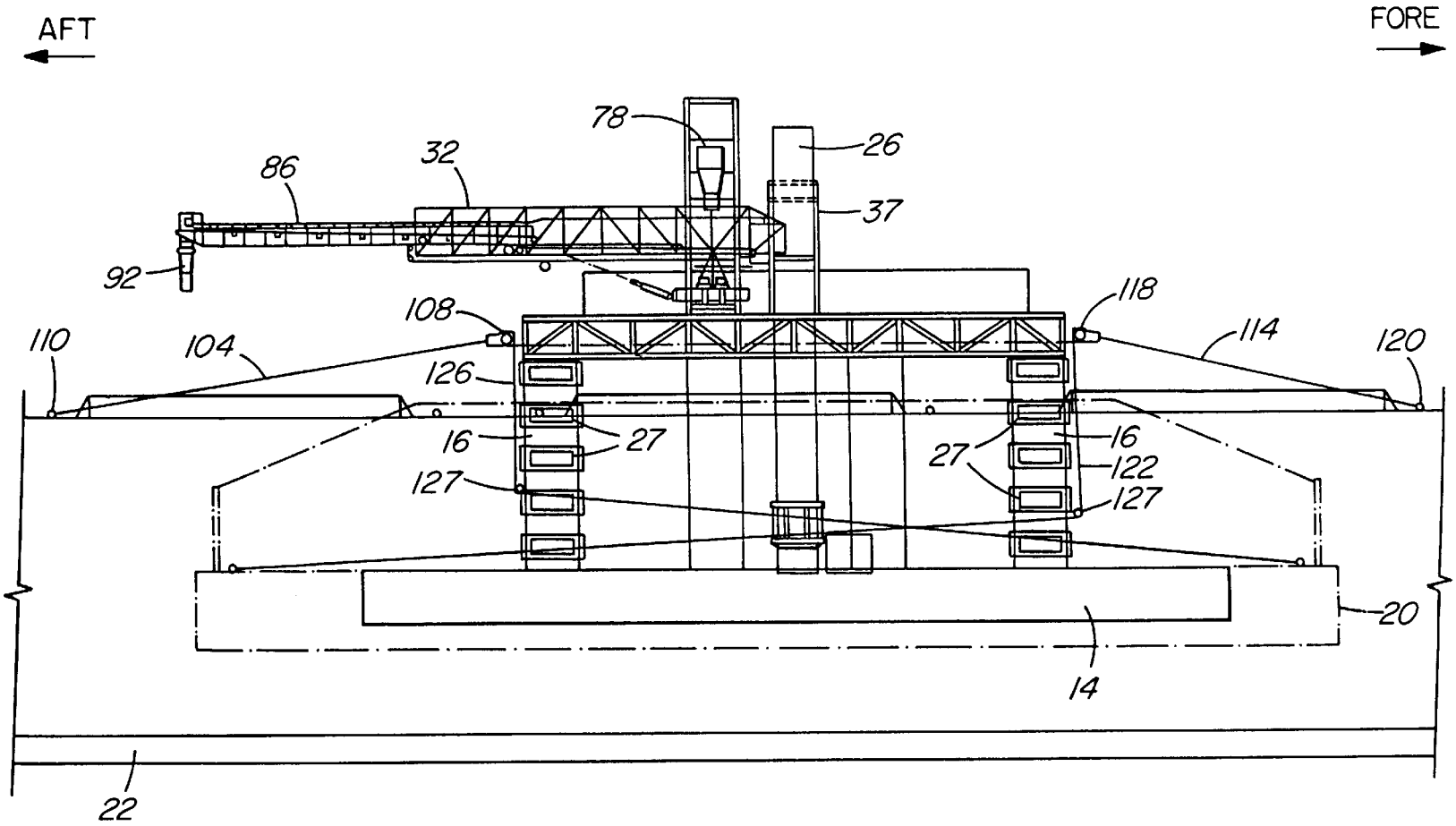
FIG. 17 is a side view of the arrangement shown in FIG. 16.

The pontoon 14 is longer than the pontoon 12. The pontoon 14 is on the inboard side of the transshipper 10, ie. on the side facing the ship 22 and the pontoon 12 is on the outboard side of the transshipper 10. As shown in FIGS. 3, 16 and 17, the front and rear legs 16 on the inboard side are provided with marine fenders 27 for cushioning contact with the side of the ship 22.

The pontoons 12, 14 form a catamaran and support the platform 18 at an elevated position above the water surface by means of the legs 16.

The pontoons 12, 14 are hollow members and each defines a chamber 28 to hold ballast water, as shown for the pontoon 14 in FIG. 2. The extent of the chamber 28 is indicated by means of the crossed lines in the drawings. It will be noted that the chamber 28 also extends upwards into the lower parts of the legs 16, as indicated by the crossed lines at 28.1.

Openings 29 are provided in the chambers 28 for the entry of ballast water. The openings 29 are closed by any suitable valve means when the required amount of ballast water has been allowed to flow into the chambers 28. Pumps 31 are provided for pumping ballast water out of the chambers 28 and/or 28.1. through outlets 33.

In use, the transshipper 10 can be towed to a required working position, eg. alongside a cargo ship, by means of a tug boat. Alternatively, the transshipper 10 may be provided with suitable propulsion means so that it can be moved into a desired working position under its own power.

The material handling apparatus 24 is supported on the platform 18.

Figure 10:
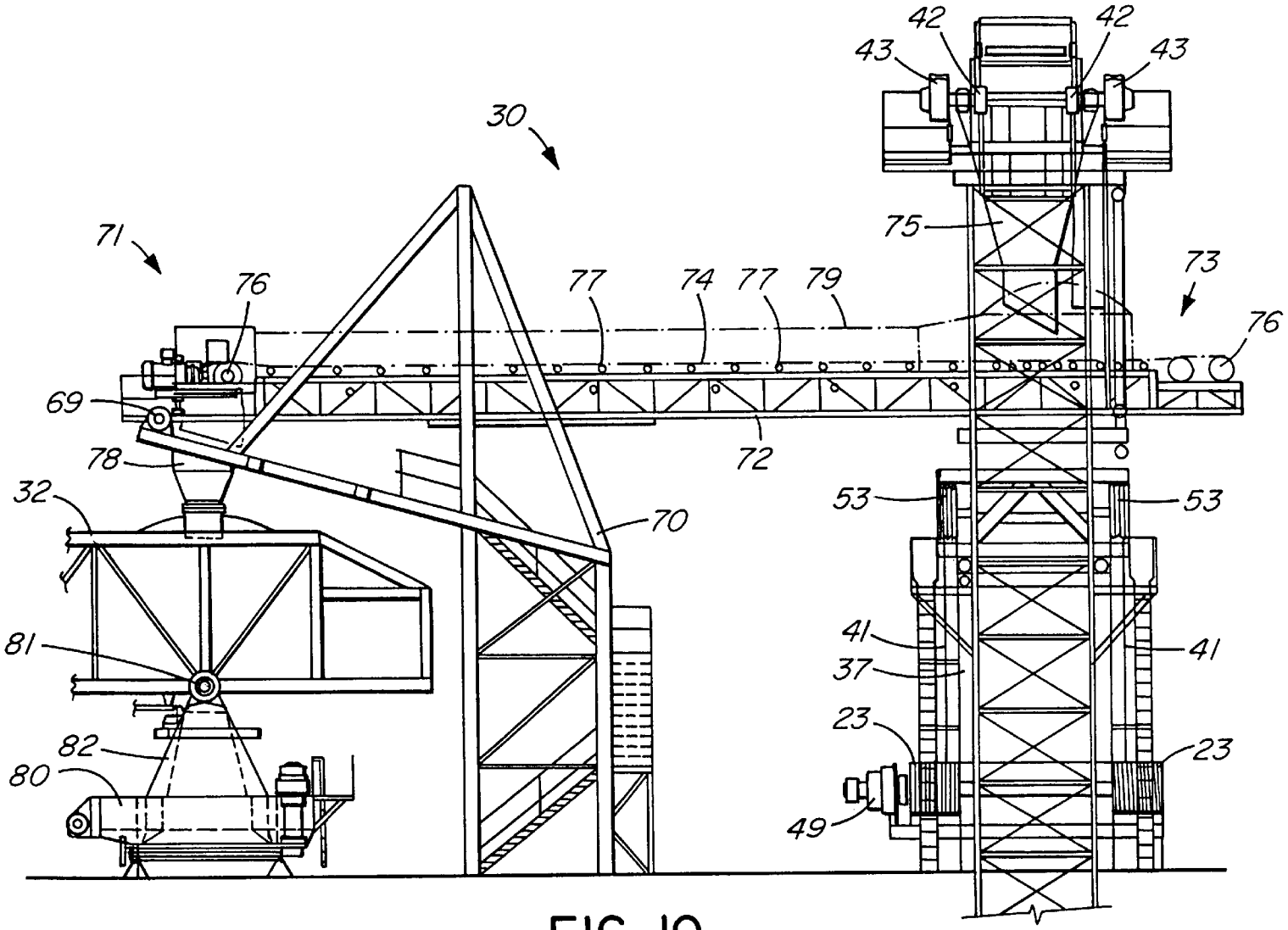
FIG. 10 is a side view of a transfer conveyor of the transshipper of FIG. 1.

The marine leg 26 comprises a bucket elevator or conveyor 25 housed in a casing 35. The casing 35 is slidably located in a supporting sleeve 37 which is mounted on the platform 18 (FIGS. 2, 3 and 10). Lifting winches 23, driven by drive motor 49, are provided for raising and lowering the marine leg 26 relative to the barge 20. As shown in FIG. 10, cables 41 extends upwardly from the winches 23 and around sheaves 53 on the upper end of the sleeve 37 and then downwardly to the lower end of the casing 35 where they are attached to the casing 35 for effecting the raising and lowering of the leg 26.

Figure 4:
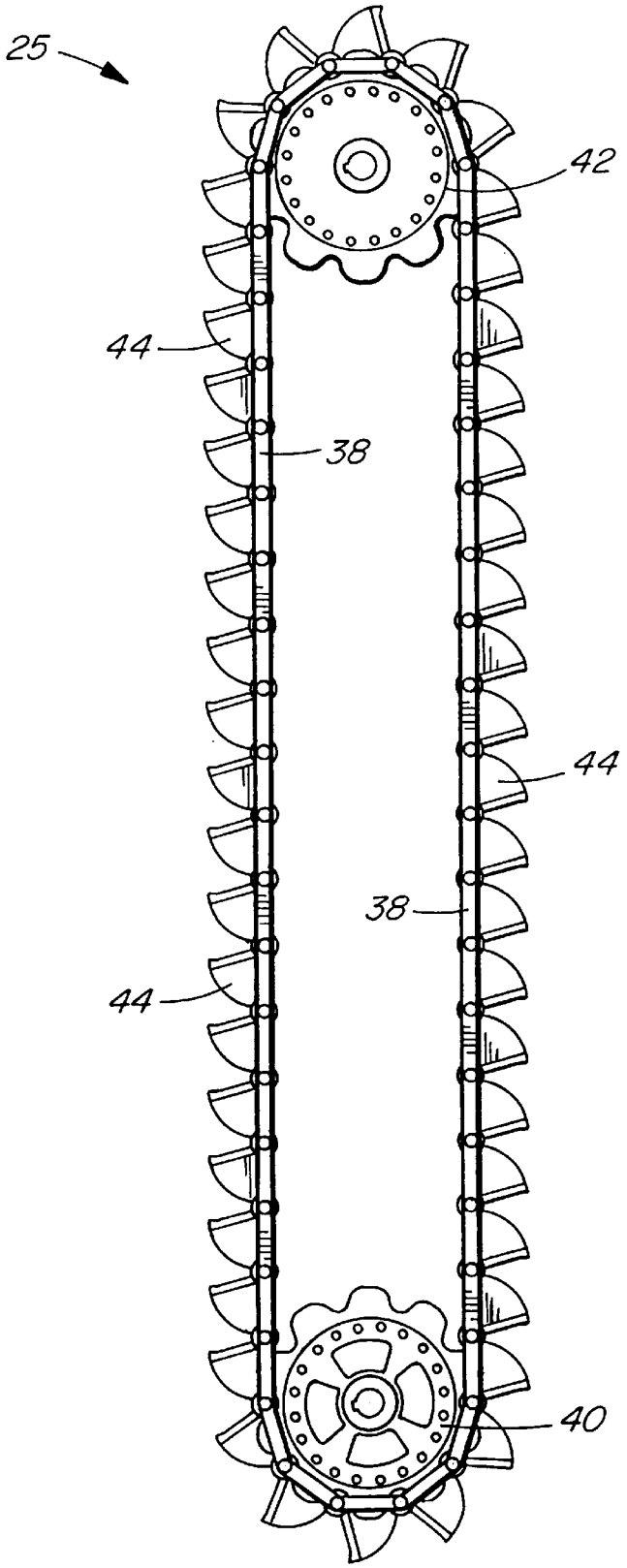
FIG. 4 is a side view of a bucket conveyor of the transshipper of FIG. 1 for raising material from a barge for discharge into the hull of a cargo ship.

The bucket conveyor 25 comprises a pair of laterally spaced endless chains 38 (FIG. 4) mounted for rotation about sprockets 40 and 42, the latter being driven by a hydraulic or electric motor 43. The driven sprocket 42 is located vertically above the other sprocket 40. Each of the sprockets 40, 42 comprises a pair of laterally spaced toothed wheels for engaging with the chains 38.

As shown, a plurality of buckets 44 is mounted between the chains 38. Each bucket 44 is mounted by means of a pair of shafts 46, each shaft 46 being common to a pair of adjacent buckets 44.

Figure 5:
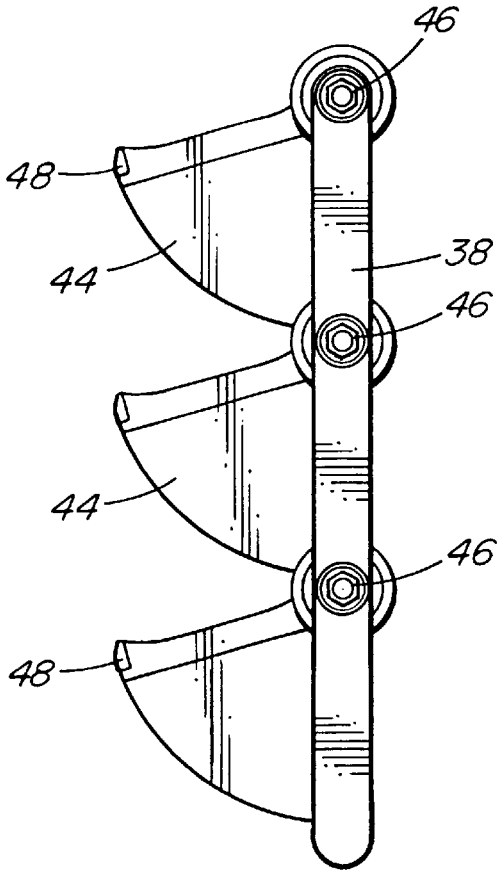
FIG. 5 is a side view showing an enlarged view of the area encircled in FIG. 4.

The buckets 44 are of steel and each is provided with an abrasion resistant digging edge 48, which may comprise a steel blade or a set of teeth, as desired. The buckets 44 are shown in greater detail in FIG. 5.

As can be seen, the buckets 44 are fixed to the chains 38 so that they will scoop up material from the barge 20 when traveling around the lower sprocket 40 and discharge material when they pass around the upper sprocket 42.

Figure 6:
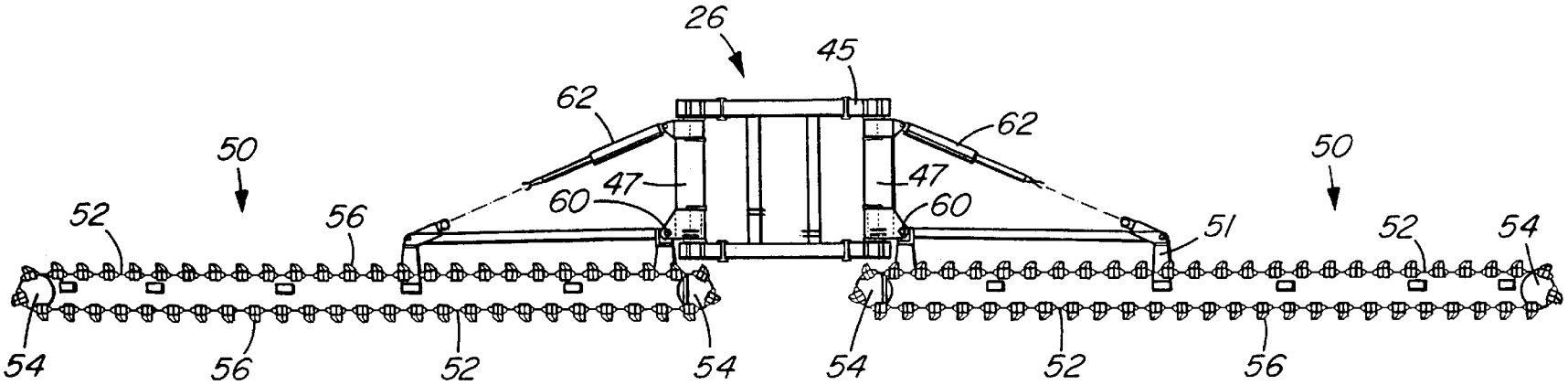
FIG. 6 is a side view of a pair of rotary scrapers associated with the bucket conveyor of FIG. 4.

In order to facilitate the operation of the bucket conveyor 25, a pair of rotary scrapers 50 is provided extending transversely of the marine leg 26, as shown in FIG. 6.

Figure 7:
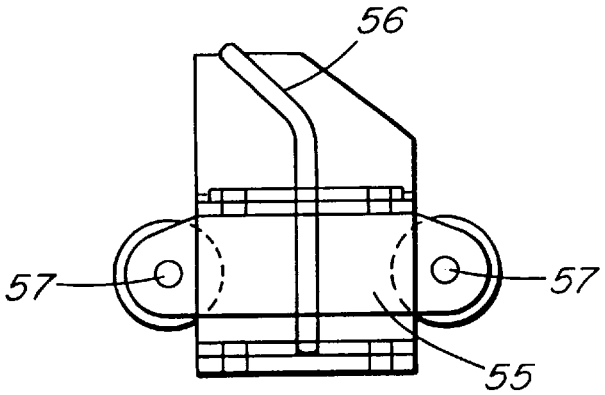
FIG. 7 is an enlarged view of the area encircled in FIG. 6, showing a side view of a scraper blade.

Each scraper 50 comprises a supporting framework 51 and an endless chain 52 which rotates around a pair of spaced sprockets 54 rotatably mounted on the framework 51. The chain 52 comprises a series of laterally spaced links 55 attached together by means shafts 57. Steel blades 56 are attached to the links 55 as shown in greater detail in FIG. 7.

The inner sprocket 54 of each pair is driven so that the steel blades 56, during their bottom pass around the sprockets 54, are moved towards the marine leg 26. In this fashion, material is fed towards the marine leg 26 by means of the scraping action of the steel blades 56.

Each rotary scraper 50 is attached to the marine leg 26 through a connecting framework 45 for movement with the marine leg 26 when the latter is raised or lowered relative to a barge 20.

Figure 8:
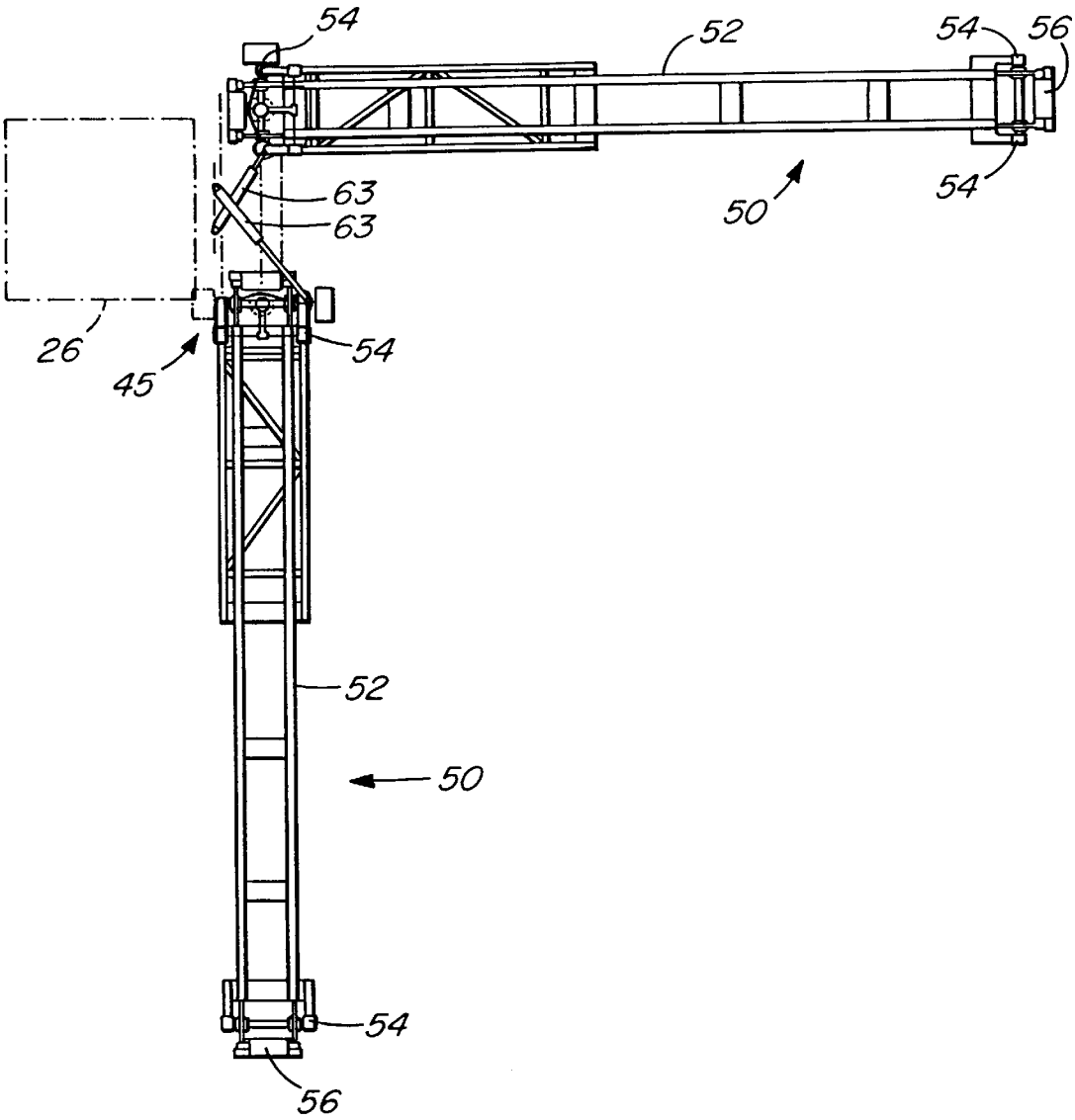
FIG. 8 is a plan view of the rotary scrapers of FIG. 6, showing the scrapers aligned at right angles to one another for illustrative purposes.
Figure 9:
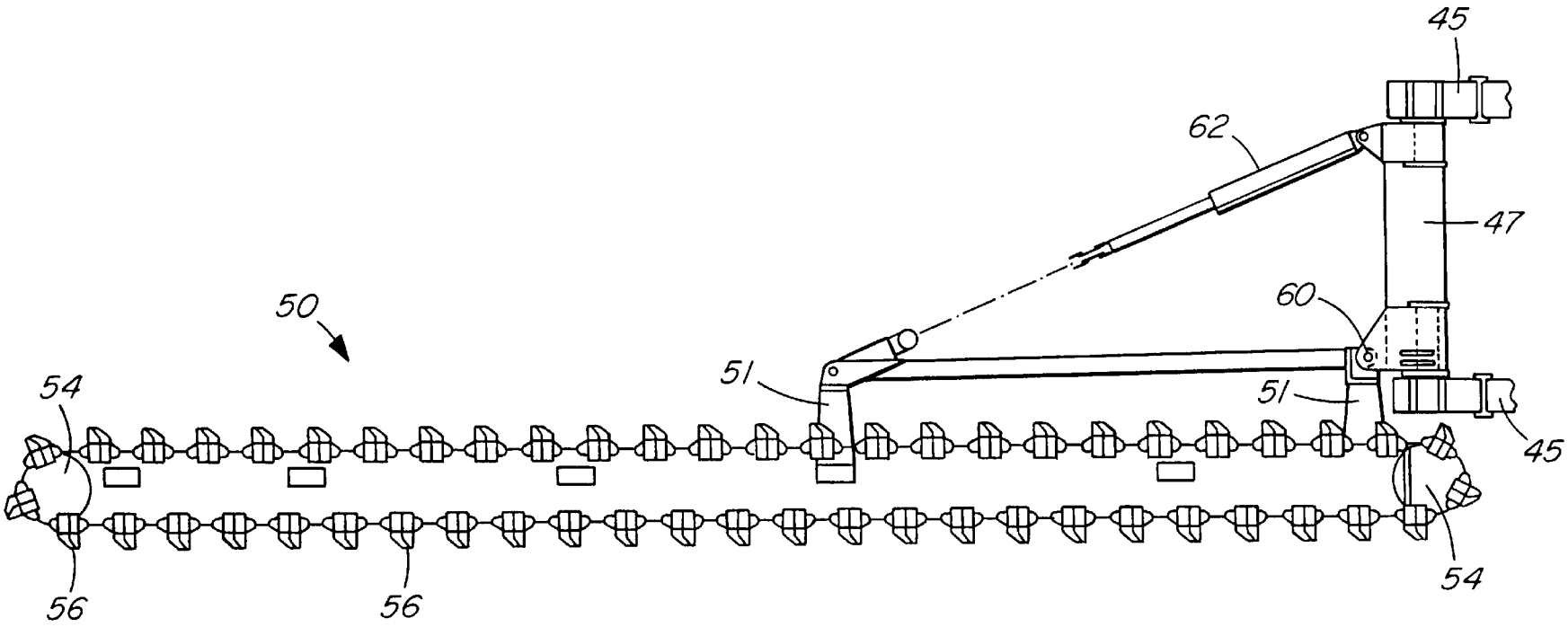
FIG. 9 is a side view of one of the scrapers of FIG. 6 on a larger scale.

The attachment of the scrapers 50 is shown in more detail in FIGS. 8 and 9. The supporting framework 51 of each scraper 50 is attached for rotation about a vertical axis by means of a cylindrical bush 47 rotatably connected to the framework 45 so that the scraper 50 can effect slewing motion relative to the marine leg 26. The connection of the framework 51 to the bush 47 is through a pivotal connection 60 (about a horizontal axis) so that the scraper 50 can also effect luffing motion relative to the marine leg 26. A hydraulic piston and cylinder assembly 62 is operative between each scraper 50 for effecting the luffing motion and a further hydraulic piston and cylinder assembly 63 is provided for effecting the slewing motion.

The transfer conveyor 30 comprises a support tower 70 and a conveyor framework or arm 72 which is attached to the support tower 70 for rotation about a horizontal axis 69. The conveyor 30 has a head end 71 and a tail end 73. The support tower 70 is mounted on the inboard side of the platform 18 which coincides with the larger pontoon 14. The conveyor 30 further comprises an endless belt 74 which is rotated around a pair of spaced rollers 76 on the arm 72. The conveyor belt 74 is supported by idler rollers 77. A discharge chute 75 is located at the upper end of the bucket conveyor 25 for receiving the material discharged by the buckets 44. The chute 75 feeds the material to the tail end 73 of the transfer conveyor 30. As the marine leg 26 is raised or lowered during operation, the conveyor arm 72 is pivoted about the axis 69 so that its tail end 73 is raised or lowered to follow the raising and lowering of the marine leg 26. In this way the conveyor belt is 74 is maintained at a constant distance beneath the chute 74 which is attached to the marine leg 26.

The material is conveyed by the conveyor belt 74 of the conveyor 30 to the head end 71 of th conveyor 30. A discharge chute 78 is located at the head end 71 of the conveyor 30. The chute 78 feeds the material to the off-loading boom 32. The conveyor 30 is provided with a hood for shielding the material being conveyed.

The boom 32 is supported on a support member 80 which is mounted on the inboard side of the platform 18 adjacent the transfer conveyor 30. The support member 80 has an uppper part 82 to which the boom 32 is attached. The upper part 82 is rotatable about a vertical axis for effecting slewing of the boom 32 in clockwise and counter-clockwise direction. The boom 32 is pivotally connected to the rotatable upper part 82 for pivotal movement about a horizontal axis 81 for luffing action of the boom 32. A hydraulic piston and cylinder assembly 84 is operatively connected between the boom 32 and the rotatable upper part 82 for effecting the luffing motion.

In order to extend the longitudinal reach of the boom 32, it is provided with a shuttle 86 which is mounted for longitudinal movement relative to the boom 32.

The shuttle 86 has two sets of wheels 83 and 85. The wheels 83 are at the rear of the shuttle 86 and the wheels 85 are spaced from the rear of wheels 83 towards the front end of the shuttle 86. The wheels 83,85 are supported between a set of upper rails 87 and lower rails 88. The rails 87, 88 maintain the shuttle 86 in a cantilevered condition when it is moved into an extended position for discharging cargo into the hold 34 of the ship 22. Stops are provided at the opposite ends of the rails 87,88 to keep the wheels 83,85 captive between the rails 87,88.

A winch 89 for extending and retracting the shuttle 86 is provided on the underside of the boom 32. A first cable 90 extends from the winch 89 around a set of sheaves 91 at the front end of the boom 32 and is attached to the shuttle 86 at a location between the wheels 83,85. A second cable 92 extends from the winch 89 around a set of sheaves 93 at the rear end of the boom 32 and is attached to the shuttle 86 at the same location as the first cable 90. The shuttle 86 can, therefore, be extended or retracted by appropriate action of the winch 89. The fully extended position of the shuttle 86 is shown in solid lines in FIG. 11 and the retracted position is shown in broken lines.

Figure 11:
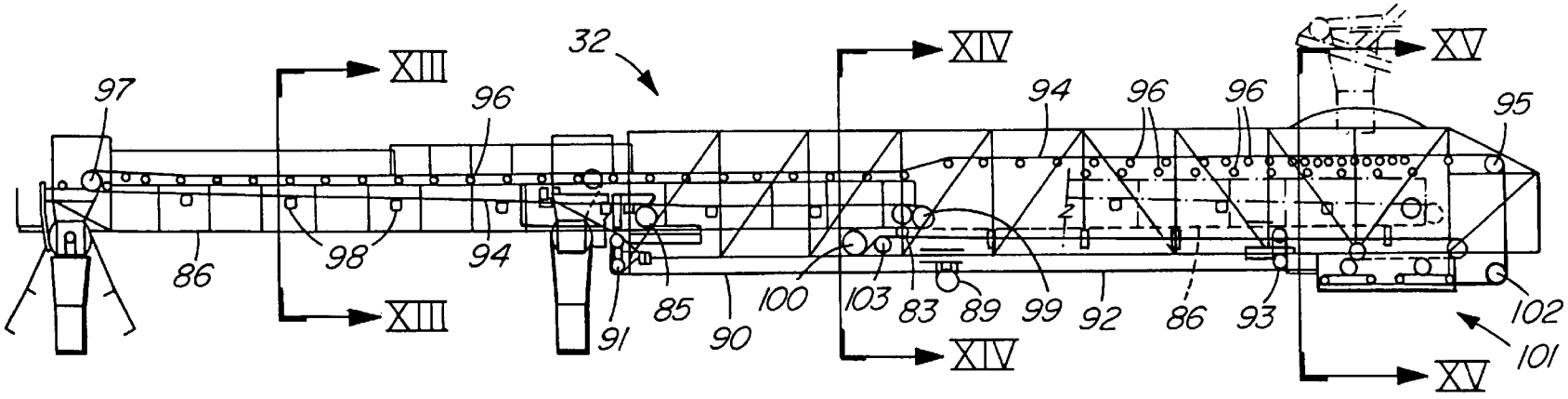
FIG. 11 and 12 are side and plan views, respectively, of an off-loading boom of the transshipper of FIG. 1.
Figure 12:
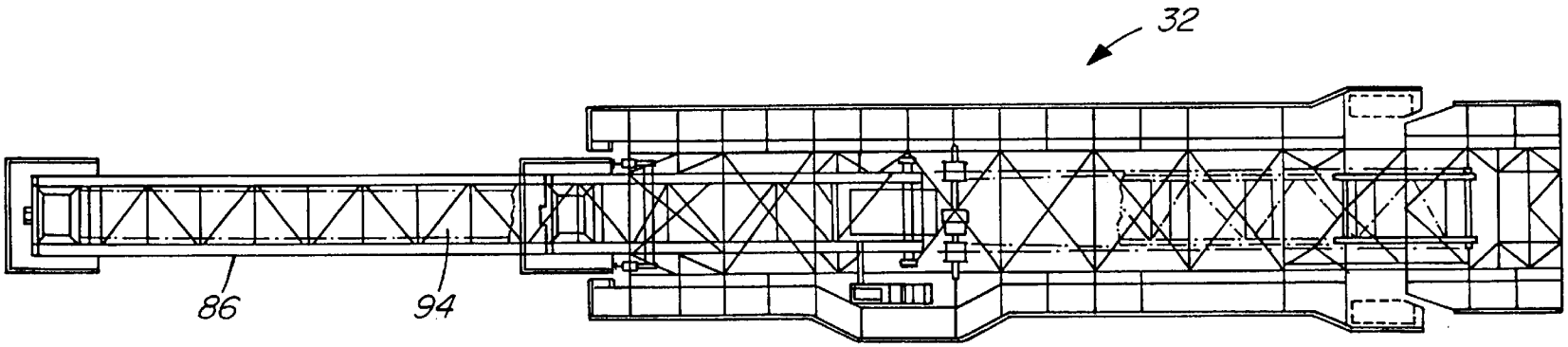
Figure 13:
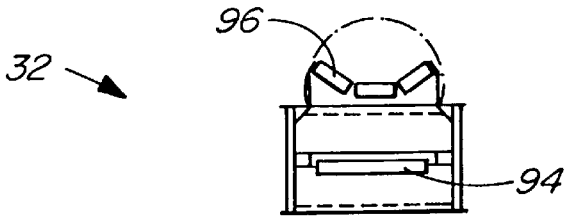
FIGS. 13 to 15 are sections along the lines XIII—XIII, XIV—XIV, XV—XV, respectively, in FIG. 11.
Figure 14:
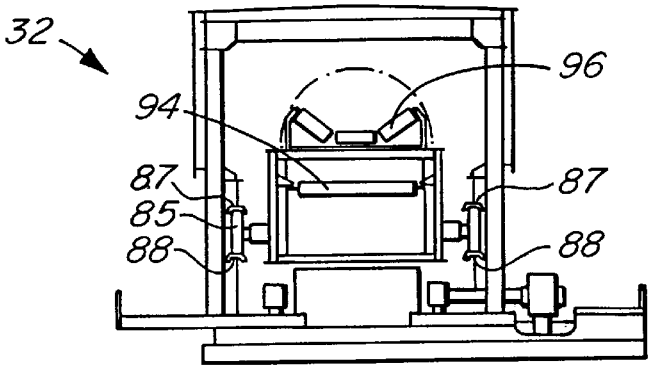
Figure 15:
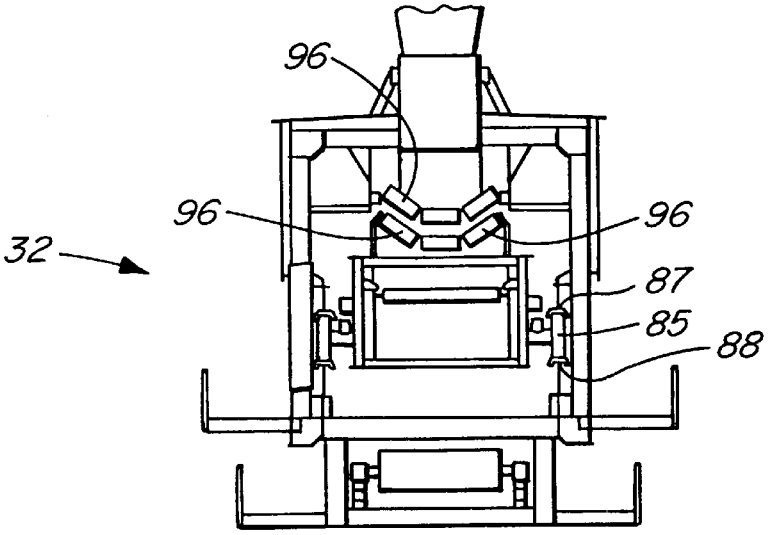

The boom 32 includes a conveyor in the form of an endless belt 94. As can be seen in FIG. 11, the belt 94 extends from a first end roller 95 over a multiplicity of idler rollers 96 extending along the boom 32 as well as along the shuttle 86. The belt 94 then extends around a head roller 97 and along a number of supporting return idlers 98 to an end roller 99 attached to the rear end of the shuttle 86. The belt 94 then extends around a drive roller 100 towards the rear end of the boom 32 where it passes around take-up rollers 101, to maintain the required tension in the belt 94, and finally around a second end roller 102 back to the first end roller 95. A snub roller 103 is provided alongside the drive roller 100 to increase the wrap of the belt 94 around the drive roller 100.

It can be seen that the length of the belt 94 is automatically adjusted as the shuttle 86 moves relative to the boom 32 by virtue of the fact that the belt 94 passes around the roller 99 at the rear end of the shuttle 86.

In use, the material being transported enters the boom 32 at its rear end through the chute 78. The material falls onto the conveyor belt 94 and is conveyed to the front end of the shuttle 86 where it falls into a chute 92 for discharge into the hull 34 of the ship 22.

Operation

First, the cargo ship 22 to be loaded is anchored, as far as possible in a position that will block the majority of ocean waves on one of its sides, ie. the exposed side. The transshipper 10 is then anchored on the opposite side of the ship 22, ie. the protected side, as will be described below. This is to protect the transshipper 10, as well as the barge 20 and the tug (not shown) towing the barge 20, as much as possible from the action of the ocean.

Once the cargo ship 22 is anchored, the transshipper 10 is towed from shore by a tug boat. The auxiliary electrical generator sets on the transshipper 10 are activated to provide electric power for the operation of the navigation and communication equipment, as well as for lighting and heating.

The transshipper 10 is positioned alongside the ship 22 at the first cargo hold 34 to be loaded. With the transshipper 10 in position, it is ballasted to a desired depth to reduce its wave plane area, which is the amount of surface area on the transshipper 10 that is open to wave action. By lowering the pontoons 12, 14, so that they are deeper in the water or even under the water level, the available surface area can be selectively reduced as required, in some instances, to only that of the leg 26.

The hydraulic power units are also started and allowed to warm up to reach the required operating pressures.

Mooring cables are attached to the transshipper 10. As can be seen from FIG. 16, two mooring cables 102, 104, respectively, extend from winches 106, 108 on the pontoons 12, 14 towards the aft end of the ship 22 and are attached to a bollard 110 on the ship 22. Two further mooring cables 112, 114, respectively, extend from winches 116, 118 on the pontoons 12, 14 towards the fore end of the ship 22 and are attached to a bollard 120 on the ship 22.

The winches 106, 108 and 116, 118 are operated to maintain the mooring cables 102, 104 and 112, 114 in a taught condition so as to hold the transshipper 10 firmly against the ship 22 to counteract damage to the ship 22 and transshipper 10. The winches 106, 108 and 116, 118 are also operated to allow the transshipper 10 to move longitudinally along the side of the ship 22 in order to move from one cargo hold to another. For this reason, the bollards 110, 120 on the ship 22 can be spaced much further apart then as shown in FIG. 8.

All tie downs and other transit protection devices on the transshipper 10, such as a boom clamping device and marine leg locking device, are removed so that it is now possible to slew the boom 32 over the desired cargo hold 34 of the ship 22, as shown in FIG. 3.

Once the transshipper 10 is in position as described above, the tug boat pulls the loaded barge 20 up to the transshipper 10. Normally the tug boat cannot pass under the platform 18 due to height restrictions.

As the barge 20 approaches the transshipper 10, traction cables are cast from the transshipper 10 to the transshipper 10 with two sets of cables 122 and 124. The first set of cables 122, located at the fore end of the transshipper 10, is attached to the aft end of the barge 20. Similarly, the second set of cables 124, located at the aft end of the transshipper 10, is attached to the fore end of the barge 20. Both sets of traction cables 122, 124 are attached to traction winches 126 on the platform 18. The winches 126 allow the transshipper 10 to move the barge 20 back and forth relative to the transshipper 10. Constant and equal tension is maintained on the cables 122, 124 to keep the barge 20 as stable as possible. Decreasing the tension in one set of traction cables, eg. 122, allows the other set, eg. 124, to pull the barge 20 and vice versa. All the traction cables 122, 124 are independent, allowing the operator to steer the barge 20 through differential cross-tension on each traction winch 126. As can be seen from FIGS. 2, 3 and 17, the traction cables 122, 124 extend downwards via fairleads 127 from the platform 18 to the barge 20.

After connecting the traction cables 122, 124, the tug boat is free to collect another loaded barge from the shore.

Initially, the winches 126 are operated to locate the barge 20 at the center of the platform 18 and the unloading operation is commenced. First the boom 32 is activated, then the transfer conveyor 30 is activated and finally the marine leg 26 and the rotary scrapers 50 are activated.

The marine leg 26 is lowered into the cargo on the barge 20 below. In the present example, the cargo is a particulate or granular material. When the buckets 44 reach the material, the material is scooped up by the buckets 44 successively digging into the material as they are rotated around the sprockets 40,42. The marine leg 26 is controlled by sensing means which senses the load it is carrying. The load on the motor 43, which is related to the amount of material being lifted, is measured. The lowering of the marine leg 26 is accordingly controlled by means of a computer so that the extent to which the buckets 44 dig into the material is such that their combined weight falls within a desired range. If the load is too great, the digging force of the buckets 44 is decreased by raising the marine leg 26 somewhat until the load is in the desired range.

In addition to the mechanism above for sensing the load on the motor 43 to control the load of the buckets 44, a compensating mechanism is provided for compensating for distance variations between the platform 18 and the barge 20 during operation, which may result due to wave action.

A pair of limiting parameters is established by measuring the load on the motor 49 which is responsible for raising and lowering the marine leg 26. A first measurement is taken when the marine leg 26 is raised above the load on the barge 20 with the buckets 44 loaded with material. The indicates a 100% load on the motor 49. A second measurement is taken with the marine leg 26 lowered so that it is supported on the load on the barge 20. This indicates a 0% load on the motor 49.

During normal operation the system is operated so that the motor 49 shares the load between itself and the barge 20 by operating at a selected value or range of values between the 100% and 0% conditions indicated above, say about 75%, so that the motor 49 carries 75% of the load and the barge 25%.

When there is a differential motion between the marine leg 26 and the barge 20 and the operating value differs from the preselected value, the marine leg 26 is automatically raised or lowered, by computer control, to compensate for the change in distance between the platform 18 and the barge 20. For example, is the distance increases so that the marine leg 26 is no longer partially supported by the load on the barge 20, i.e. it increase on the load of the motor 49 and the marine leg 26 is lowered. If the distance decreases so that the marine leg 26 is forced onto the load on the barge 20, it is detected as a decrease in the load of the motor 49 and the marine leg 26 is raised.

During operation of the marine leg 26, the hydraulic piston and cylinder assemblies 62 are activated to lower the scrapers 50 for scraping or pulling the material towards the marine leg 26.

The marine leg 26 is progressively lowered until a predetermined or ideal depth, referred to as the first cut depth, depending on the size and capacity of the barge 20, is reached. After this depth is reached, the winches 126 are activated to pull the barge 20 fore and aft relative to the platform 18 by means of the traction cables 122, 124. In this fashion, the entire barge 20 is cleared to the first cut depth. At the end of this cycle, the marine leg 26 is raised and again centered under the platform 18, and a second cycle, to clear the barge 20 to a second cut depth, is commenced. This cycle is continued through several cut depths, as desired, until the barge 20 is completely unloaded. After the final clean out, the marine leg 26 is raised and shut off.

A second loaded barge is towed by the tug boat to the empty barge. The mooring cables 102,104 and 112,114 on the empty barge are intensioned. The aft traction cables are disconnected from the empty barge and attached to the fore of the loaded barge. The loaded barge is pulled by the traction cables up to the empty barge and temporary mooring cables are used to connect the two barges. The tug boat now moves around to the fore of the transshipper 10 waiting for release of the empty barge. The fore traction cables are disconnected from the empty barge and are moved to the aft of the loaded barge. The traction cables pull the empty barge and the loaded barge until the loaded barge is centered under the marine leg 26. The traction cables are now tensioned to hold the loaded barge stationary. The temporary mooring cables are disconnected and the tug boat is connected to the empty barge and tows it away.

The cycle of bringing in a further loaded barge, reclaiming of the bulk material from barge and removal of the empty barge continues until the ship 22 is fully loaded. As each hold 34 fills up, the boom 32 is slewed to other holds. To reach holds outside the boom's slewing range, the entire transshipper 10 is moved along the length of the ship 22. As indicated above, the mooring cables are used for this movement. As with the barge traction cables, tension is released in one set of cables allowing the other set to pull the transshipper 10. When the last barge is unloaded, it is detached from the transshipper 10 and towed away.

The transshipper 10 is then shut down and prepared for its voyage back to its shore berth. All the conveyors are shut down. The barge traction cables are stored. The boom 32 is slewed back to its parking bolster and secured. The marine leg 26 is secured. The transshipped 10 is attached to the tug. Mooring cables are released and stored. Hydraulic power is turned off. The transshipper 10 is deballasted to its transit mode. Main electrical generator sets are shut down. The tug boat pulls the transshipper 10 to shore for berthing until its next use.

The transshipper 10 facilitates the loading of bulk material in locations that have limited draft and shore facilities. Barges of almost any type can be used. Similarly, ships to be loaded, as well as on shore stockpiles, can vary. Given the specific requirements of the barges, ships and/or on shore stockpile, the transshipper 10 can be designed to meet the specific requirements.

In the example described above, the barge 20 is accommodated between the pontoons 12, 14 during the cargo transfer operation. However, the pontoons 12, 14 can be spaced closer together in the situations where a barge or ship being unloaded is placed alongside the transshipper 10, ie. on the outboard side thereof.

While only preferred embodiments of the invention have been described herein in detail, the invention is not limited thereby and modifications can be made within the scope of the attached claims.

What is claimed is:

1. A transshipper for floating on water, comprising:

a pair of buoyant vessels;

a platform supported by the buoyant vessels in a raised position above the buoyant vessels through a plurality of vertical columns connecting the platform to the buoyant vessels;

a ballast chamber in each buoyant vessel for receiving water as ballast inside the buoyant members, means for effecting entry or discharge of water into or from the ballast chambers, whereby the buoyant vessels are, respectively, lowered or raised in the water;

a lifting conveyor for raising material to be unloaded from a barge to the platform and means for raising and lowering the lifting conveyor relative to the barge; and connection means for attachment to a barge loaded with a supply of material, the connection means including traction means for effecting translational movement of the barge relative to the transshipper.

2. The transshipper of claim 1, wherein the ballast chambers extend into at least some of the vertical columns.

3. The transshipper of claim 1, wherein one buoyant vessel has a larger water displacement surface than the other buoyant vessel.

4. The transshipper of claim 1, further comprising scraping means for moving the material to be unloaded towards the lifting conveyor.

5. The transshipper of claim 4, wherein the scraping means comprises a pair of rotary scrapers extending from the lifting conveyor, each rotary scraper comprising an endless member rotatably mounted on a pair of spaced sprockets and including a plurality of scraper blades spaced along the endless member.

6. The transshipper of claim 5, further comprising means for changing the orientation of the rotary scrapers relative to the lifting conveyor.

7. The transshipper of claim 1, wherein the connection means comprises a pair of opposed traction lines for connection to opposite ends of the barge and traction winches for exerting pulling forces on the traction lines for effecting said translational movement.

8. A transshipper for floating on water comprising a pair of spaced buoyant vessels for receiving a barge therebetween, a platform supported by the buoyant vessels in a raised position above the buoyant vessels through a plurality of vertical columns connecting the platform to the buoyant vessels, wherein the buoyant vessels are provided with ballast chambers therein for receiving water as ballast inside the buoyant members, the ballast chambers being provided with valve controlled inlets for the introduction of water into the ballast chambers and including means for pumping water from the ballast chambers for discharge of water from the ballast chambers, whereby the buoyant vessels are, respectively, lowered or raised in the water.

9. The transshipper of claim 8, wherein the ballast chambers extend into at least some of the vertical columns.

10. The transshipper of claim 9, wherein the ballast chambers are provided with outlets in the vertical columns for said discharge of water from the ballast chambers.

11. The transshipper of claim 8, wherein one buoyant vessel has a larger water displacement surface than the other buoyant vessel.

12. The transshipper of claim 8, further comprising a lifting conveyor for raising material to be unloaded from a barge to the platform and means for raising and lowering the lifting conveyor relative to the barge.

13. The transshipper of claim 12, further comprising scraping means for moving the material to be unloaded towards the lifting conveyor.

14. The transshipper of claim 13, wherein the scraping means comprises a pair of rotary scrapers extending from the lifting conveyor, each rotary scraper comprising an endless member rotatably mounted on a pair of spaced sprockets and including a plurality of scraper blades spaced along the endless member.

15. The transshipper of claim 14, further comprising means for changing the orientation of the scraper members relative to the lifting conveyor.

16. The transshipper of claim 8, further comprising connection means for attachment to a barge loaded with a supply of material, the connection means including traction means for effecting translational movement of the barge relative to the transshipper.

17. The transshipper of claim 16, wherein the connection means comprises a pair of opposed traction line for connection to opposite ends of the barge and traction winches for exerting pulling forces on the traction lines for effecting said translational movement.

18. A transshipper for floating on water comprising a pair of buoyant vessels, a platform supported by the buoyant vessels through a plurality of vertical columns connecting the platform to the buoyant vessels;

a lifting conveyor for raising material to be unloaded from a barge to the platform; and a winch for raising and lowering the lifting conveyor relative to the barge.

19. The transshipper of claim 18, further comprising scraping means for moving the material to be unloaded towards the lifting conveyor.

20. The transshipper according to claim 19, wherein the scraping means comprises a pair of rotary scrapers extending from the lifting conveyor, each rotary scraper comprising an endless member rotatably mounted on a pair of spaced sprockets and including a plurality of scraper blades spaced along the endless member.

21. The transshipper according to claim 20, further comprising means for changing the orientation of the scraper members relative to the lifting conveyor.

22. The transshippper of claim 18, wherein the buoyant vessels are provided with ballast chambers therein for receiving water as ballast inside the buoyant vessels, the ballast chambers being provided with valve controlled inlets for the introduction of water into the ballast chambers and including means for pumping water from the ballast chambers for discharge of water from the ballast chambers, whereby the buoyant vessels are, respectively, lowered or raised in the water.

23. The transshipper of claim 22, wherein the ballast members extend into at least some of the vertical columns.

24. The transshipper of claim 23, wherein one buoyant vessel has a larger water displacement surface than the other buoyant vessel.

25. The transshipper of claim 18, further comprising connection means for attachment to a barge loaded with a supply of material, the connection means including traction means for effecting translational movement of the barge relative to the transshipper.

26. The transshipper of claim 25, wherein the connection means comprises a pair of opposed traction lines for connection to opposite end of the barge and traction winches for exerting pulling forces on the traction lines for effecting said translational movement.

27. A transshipper comprising a pair of buoyant vessels, a platform supported by the buoyant vessels in a raised position above the buoyant vessels through a plurality of vertical columns connecting the platform to the buoyant vessels; and connection means for attachment to a barge loaded with a supply of material, the connection means including traction means for effecting translational movement of the barge relative to the transshipped; wherein the connection means comprises opposed pairs of traction lines for connection to opposite ends of the barge and traction winches for exerting pulling forces on the traction lines for effecting said translational movement.

28. The transshipper of claim 27, wherein the buoyant vessels are provided with ballast chambers therein for receiving water as ballast inside the buoyant vessels.

29. The transshipper of claim 28, wherein the ballast chambers extend into at least some of the vertical columns.

30. The transshipper of claim 29, wherein one buoyant vessel has a larger water displacement surface than the other buoyant vessel.

31. The transshipper of claim 27, further comprising a lifting conveyor for raising material to be unloaded from a barge to the platform and means for raising and lowering the lifting conveyor relative to the barge.

32. The transshipper of claim 31, further comprising scraping means for moving the material to be unloaded towards the lifting conveyor.

33. The transshipper of claim 32, wherein the scraping means comprises a pair of rotary scrapers extending from the lifting conveyor, each rotary scraper comprising an endless member rotatably mounted on a pair of spaced sprockets and including a plurality of scraper blades spaced along the endless member.

34. The transshipper of claim 33, further comprising means for changing the orientation of the scraper members relative to the lifting conveyor.

35. A method of unloading particulate or granular material from a barge by means of material handling apparatus, comprising the steps of:

removing material from a first selected location on the barge to a first depth;

moving the barge relative to the material handling apparatus to remove material to said first depth from location on the barge adjacent to said first selected location;

removing material from a second selected location on the barge to a second depth;

moving the barge relative to the material handling apparatus to remove material to said second depth from locations on the barge adjacent to said second selected location; and repeating the removal of material to successive depths until the barge is fully unloaded or the unloading operation is terminated.

36. The method according to claim 35, wherein said second selected location corresponds with said first selected location.

* * * * *